US007909453B2

(12) United States Patent
Noro et al.

(10) Patent No.: US 7,909,453 B2
(45) Date of Patent: Mar. 22, 2011

(54) ULTRAVIOLET IRRADIATION DEVICE AND INK EJECTION DEVICE

(75) Inventors: Hideo Noro, Minamiminowa-mura (JP); Shinichi Kamoshida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/417,678

(22) Filed: Apr. 3, 2009

(65) Prior Publication Data

US 2009/0251520 A1 Oct. 8, 2009

(30) Foreign Application Priority Data

Apr. 4, 2008 (JP) ..... 2008-098463

(51) Int. Cl.
*B41J 2/01* (2006.01)

(52) U.S. Cl. ..... 347/102

(58) Field of Classification Search ..... 347/102, 347/34

See application file for complete search history.

(56) References Cited

U.S. PATENT DOCUMENTS

| | | | | |
|---|---|---|---|---|
| 5,786,835 | A * | 7/1998 | Ikeda et al. | 347/106 |
| 6,863,385 | B2 * | 3/2005 | Jeanmarie et al. | 347/77 |
| 2009/0207223 | A1 * | 8/2009 | Cofler et al. | 347/102 |

FOREIGN PATENT DOCUMENTS

| | | |
|---|---|---|
| JP | 2006-239871 | 9/2006 |

* cited by examiner

*Primary Examiner* — Matthew Luu
*Assistant Examiner* — Lisa M Solomon
(74) *Attorney, Agent, or Firm* — Workman Nydegger

(57) ABSTRACT

An ultraviolet irradiation device includes: a light source which irradiates ultraviolet curable ink with ultraviolet rays; and a jetting port which jets gas to form a gas film facing the light source in an irradiation direction.

12 Claims, 14 Drawing Sheets

ULTRAVIOLET IRRADIATION DEVICE AND INK EJECTION DEVICE

CROSS-REFERENCE TO RELATED APPLICATION

The entire disclosure of Japanese Patent Application No. 2008-098463, filed Apr. 4, 2008 is expressly incorporated by reference herein.

BACKGROUND

1. Technical Field

The present invention relates to an ultraviolet irradiation device and an ink ejection device.

2. Related Art

As one of ultraviolet irradiation devices irradiating ultraviolet rays, there is a device having a light source for irradiating ultraviolet curable ink with ultraviolet rays. Herein, the ultraviolet curable ink is ink which is cured when being irradiated with ultraviolet rays.

The above-described ultraviolet irradiation device is used as an independent device or a constituent part of a certain device. For example, the ultraviolet irradiation device may be used as a constituent part of an ink ejection device. As the ink ejection device, an ink jet printer which ejects ink onto various mediums such as paper, cloth and a film to print an image has been known. In this printer, ultraviolet curable ink ejected onto a medium is irradiated with ultraviolet rays from a light source to cure the ultraviolet curable ink, and as a result, an image is printed on the medium (JP-A-2006-239871).

However, when floating ultraviolet curable ink matter, which floats around the light source, is adhered to the light source, there is concern that ultraviolet irradiation strength and efficiency of the light source may be reduced.

SUMMARY

An advantage of some aspects of the invention is that it provides an ultraviolet irradiation device and an ink ejection device performing in which ultraviolet irradiation is performed by a light source in an appropriate manner.

According to an aspect of the invention, an ultraviolet irradiation device includes: a light source which irradiates ultraviolet curable ink with ultraviolet rays; and a jetting port which jets gas to form a gas film facing the light source in an irradiation direction.

Other features of the invention is apparent from the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
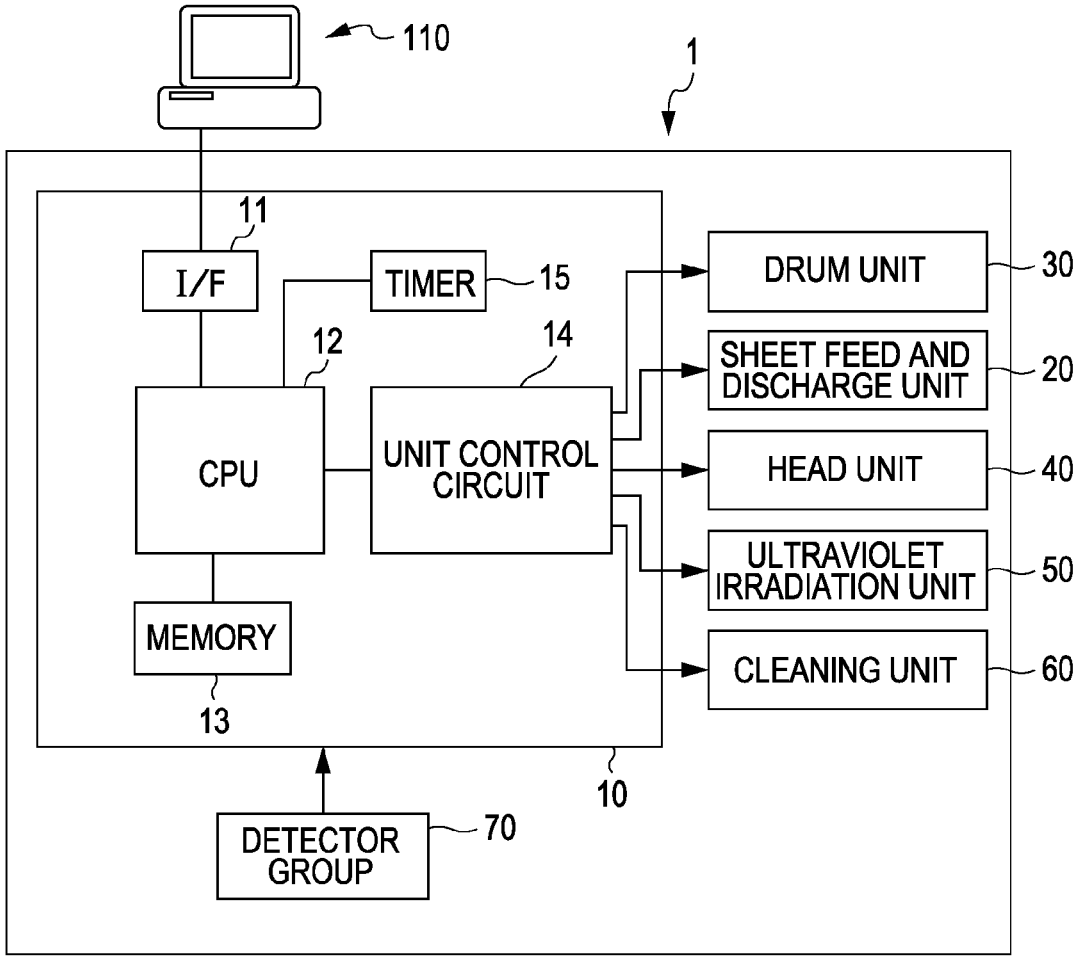
FIG. 1 is a block diagram illustrating the whole configuration of a printer.

The following description is apparent from the specification and the accompanying drawings.

An ultraviolet irradiation device includes: a light source which irradiates ultraviolet curable ink with ultraviolet rays; and a jetting port which jets gas to form a gas film facing the light source in an irradiation direction.

Thanks to the ultraviolet irradiation device, the adherence of floating matter to the light source can be suppressed by the gas film and thus ultraviolet irradiation of the light source can be performed in an appropriate manner.

In the ultraviolet irradiation device, it is preferable that the jetting port is provided at one end in an intersecting direction with respect to the irradiation direction to jet the gas toward the other end in the intersecting direction, and that the ultraviolet irradiation device further comprises a duct which is provided at the other end in the intersecting direction to suck the gas jetted from the jetting port.

In this case, since a flow of the gas jetted from the jetting port is limited, the gas film opposed to the light source in the irradiation direction can be easily formed.

It is preferable that the ultraviolet irradiation device further includes: a transparent plate which is provided to be closer to the light source than the jetting port in the irradiation direction and face the light source to transmit the ultraviolet rays irradiated from the light source.

In this case, since the flowing of floating matter to the light source is blocked by the transparent plate, the adherence of the floating matter to the light source can be effectively suppressed.

In the ultraviolet irradiation device, it is preferable that the jetting port is a pipe, and that a normal line, which passes through the center of the jetting port, of a virtual place including a top end face of the jetting port passes over the light source.

In this case, the gas passes over the light source and thus the gas jetted from the jetting port easily passes over the light source. Accordingly, the gas film opposed to the light source in the irradiation direction can be effectively formed.

In the ultraviolet irradiation device, it is preferable that a predetermined number of the light sources are arranged in an arrangement direction, that a predetermined number of the jetting ports are arranged in the arrangement direction, and that the predetermined number of the jetting ports jet the gas to form the film for the predetermined number of the corresponding light sources.

In this case, since the gas film is formed for the light sources by the jetting ports corresponding to the light sources, the reduction of an irradiation strength of each light source can be suppressed.

It is preferable that the ultraviolet irradiation device is provided in an ink ejection device having a head which ejects the ultraviolet curable ink onto a medium, and serves as an irradiation section which irradiates with the ultraviolet rays the ultraviolet curable ink adhered onto the medium.

In this case, since the ultraviolet curable ink adhered to the medium is properly cured, the deterioration of an image quality of a printed image can be suppressed.

It is preferable that the ink ejection device includes a rotation body rotating and holding the medium on an outer circumferential surface opposed to the light source, and that the jetting port jets the gas in a rotation direction of the rotating rotation body.

In this case, since a force of the gas jetted from the jetting port increases with the rotation of the rotation body, the adherence of floating matter to the light source can be effectively suppressed.

It is preferable that the ultraviolet irradiation device is provided in an ink ejection device having a head which ejects the ultraviolet curable ink onto a medium, and serves as an irradiation section which irradiates with the ultraviolet rays the ultraviolet curable ink which is not adhered to the medium and then is recovered.

In this case, since the ultraviolet curable ink is properly cured, a disposal process for the ultraviolet curable ink is easily performed.

An ink ejection device includes: a head which ejects ultraviolet curable ink; a light source which irradiates the ultraviolet curable ink ejected from the head with ultraviolet rays; and a jetting port which jets gas to form a gas film facing the light source in an irradiation direction.

Thanks to the ink ejection device, the adherence of floating matter to the light source can be suppressed by the gas film and thus ultraviolet irradiation of the light source can be performed in an appropriate manner.

—Outline of Ink Jet Printer—

By taking an ink jet printer (hereinafter, referred to as the printer 1) as an example of an ink ejection device, examples of the configuration and printing of the printer 1 will be described.

<<Configuration of Printer 1>>

Figure 2:
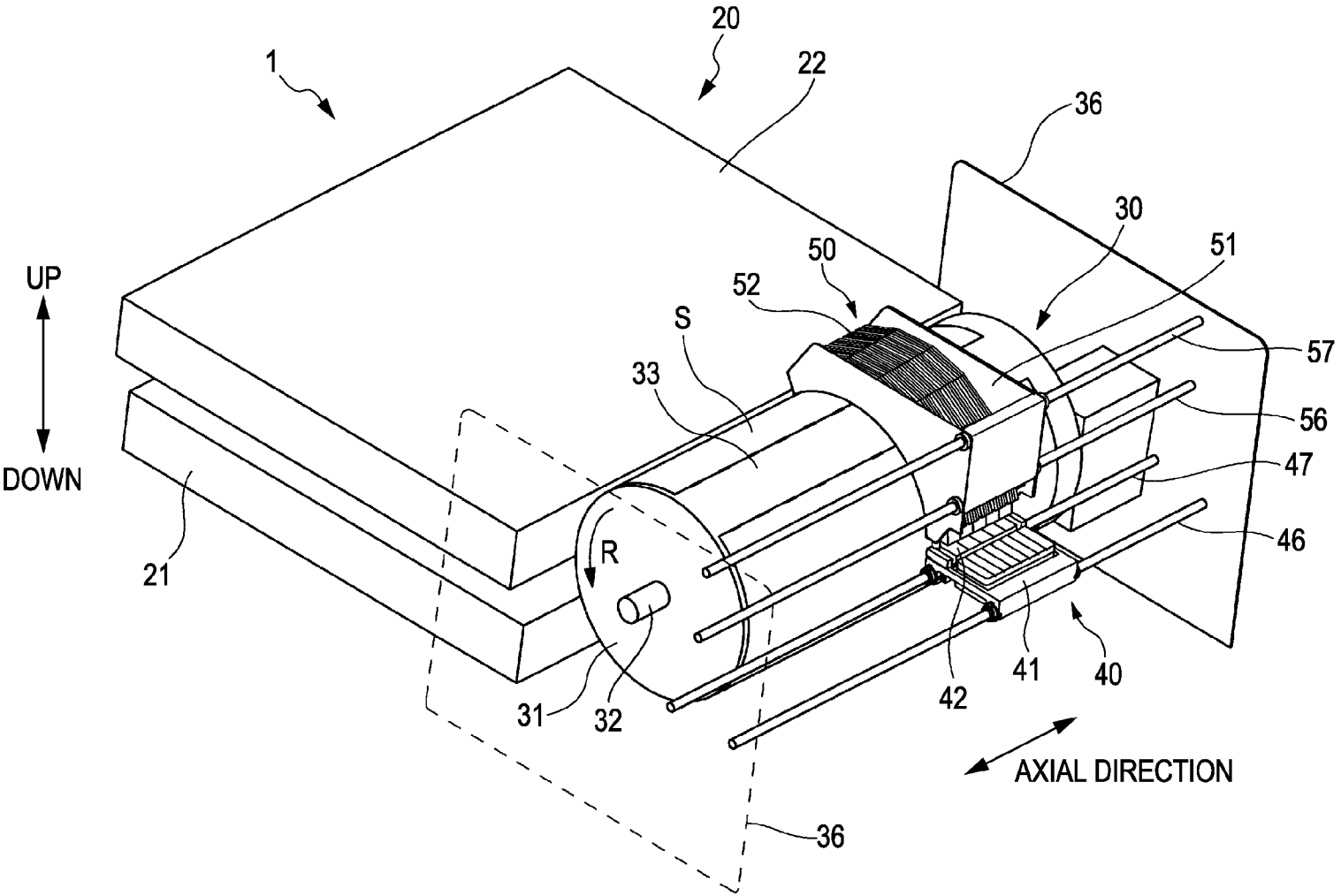
FIG. 2 is a diagram illustrating the configuration of a main part of the printer.
Figure 3:
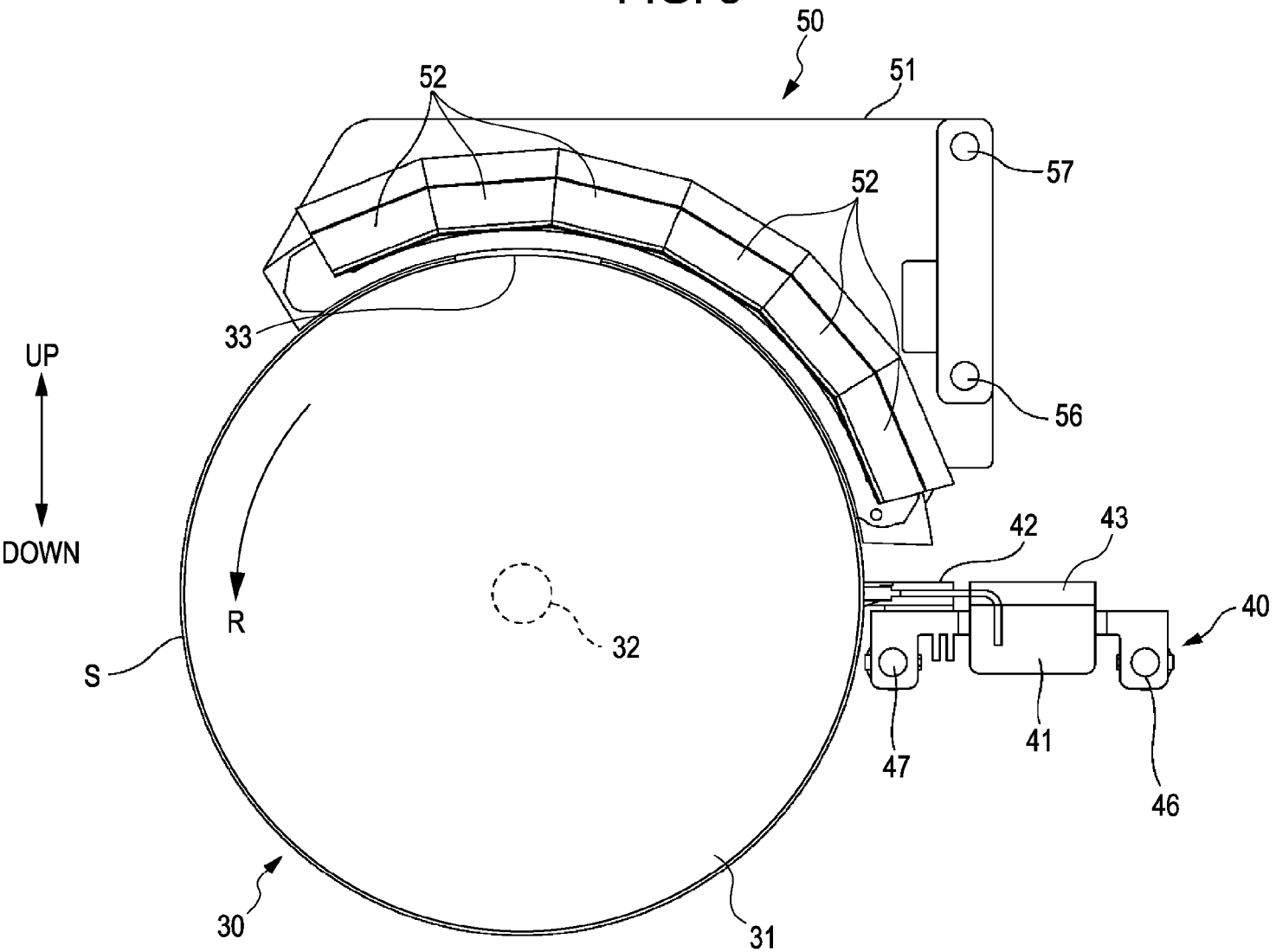
FIG. 3 is a diagram illustrating the cross-section structures of a drum unit, a head unit and an ultraviolet irradiation unit.
Figure 4A:
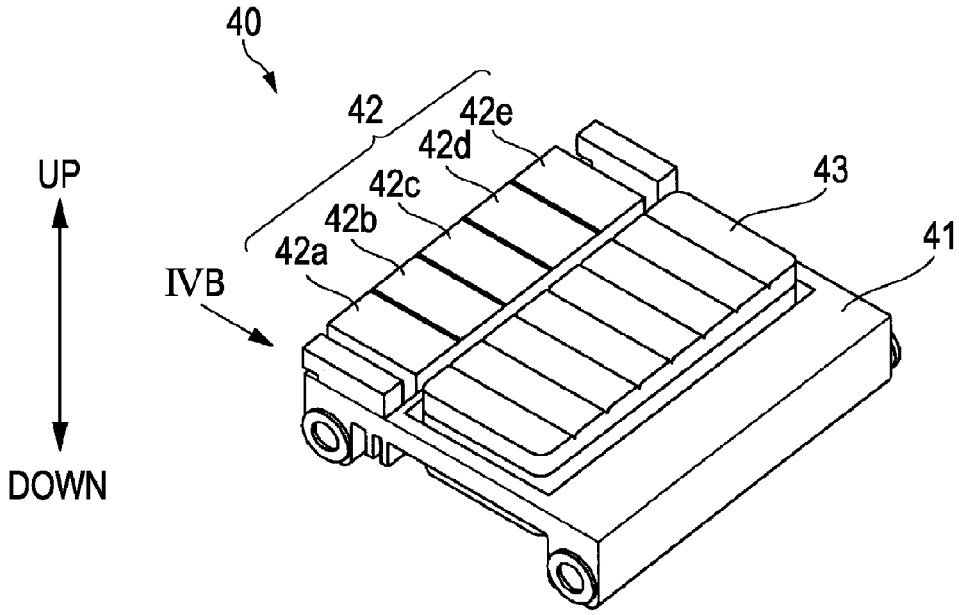
FIG. 4A is a perspective view illustrating the head unit.
Figure 4B:
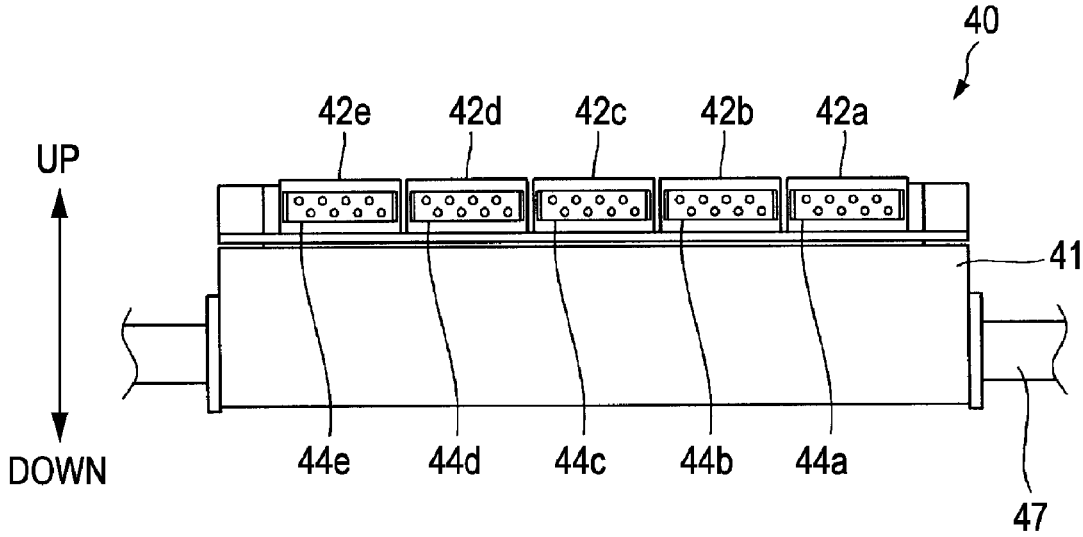
FIG. 4B is a front view of a head, as viewed in a direction shown by the arrow F of FIG. 4A.

FIG. 1 is a block diagram illustrating the whole configuration of the printer 1. FIG. 2 is a diagram illustrating the configuration of a main part of the printer 1. FIG. 3 is a diagram illustrating the cross-section structures of a drum unit 30, a head unit 40 and an ultraviolet irradiation unit 50. FIG. 4A is a perspective view illustrating the head unit 40. FIG. 4B is a front view of a head 42, as viewed in a direction shown by the arrow F of FIG. 4A.

The printer 1 receiving print data from a computer 110 as an external device controls units (sheet feed and discharge unit 20, drum unit 30, head unit 40, ultraviolet irradiation unit 50 and cleaning unit 60) by a controller 10 to form an image on a sheet S which is an example of a medium (printing). A detector group 70 monitors circumstances in the printer 1 and the controller 10 controls the units on the basis of a detection result of the detector group 70.

The controller 10 is a control unit for controlling the printer 1. An interface unit 11 is used to perform data transmission and data reception between the computer 110 as an external device and the printer 1. A CPU 12 is a calculation device for controlling the whole printer 1. A memory 13 is used to ensure a working area and an area for storing a program of the CPU 12. The CPU 12 controls the units by a unit control circuit 14 in accordance with the program stored in the memory 13.

As illustrated in FIG. 2, the sheet feed and discharge unit 20 includes a sheet feed section 21 and a sheet discharge section 22. The sheet feed section 21 has a sheet feed roller (not shown) for transporting sheets S to feed the sheets S stacked in the sheet feed section 21 to the drum unit 30 one by one. The sheet discharge section 22 has a sheet discharge roller (not shown) for transporting sheets S to send the sheets S, which are held on the drum unit 30 and on which printing is completed, into the sheet discharge section 22.

The drum unit 30 has a holding drum 31 for holding a sheet S fed from the sheet feed section 21. A rotation shaft 32 of the holding drum 31 is rotatably supported by a pair of frames 36. In addition, the holding drum 31 is rotated in a direction of the arrow R shown in FIG. 2 in a state in which a sheet S is held on an outer circumferential surface 33.

The head unit 40 has a head carriage 41 which is supported by a pair of guide shafts 46 and 47 and can be reciprocated in an axial direction of the holding drum 31. The head carriage 41 is provided with a head 42 for ejecting ink onto a sheet S. Herein, in this embodiment, as the head 42, 5 heads 42*a* to 42*e* (FIG. 4B) which eject different color inks, respectively, are provided to be opposed to a sheet S held by the holding drum 31. The heads 42*a* to 42*e* have nozzle plates 44*a* to 44*e* having plural nozzles, respectively, and ink is ejected from the nozzles. Each nozzle is provided with a pressure chamber (not shown) filled with ink and a driving element (piezoelectric element) for ejecting ink by changing a capacity of the pressure chamber.

The head carriage 41 is provided with a storage chamber 43 for storing ink. A constant amount of ink is supplied to the head 42 from the storage chamber 43. In this embodiment, as the ink, ultraviolet curable ink (hereinafter, referred to as the UV ink) which is cured by being irradiated with ultraviolet rays is used. Herein, the UV ink is prepared by adding an auxiliary agent such as an antifoam agent and a polymerization inhibitor to a mixture of a vehicle, a photopolymerization initiator and a pigment. The vehicle is prepared by adjusting viscosity of oligomers and monomers having photopolymerization curability with a reactive diluent.

The ultraviolet irradiation unit 50 has an irradiation section carriage 51 which is supported by a pair of guide shafts 56 and 57 and can be reciprocated in the axial direction of the holding drum 31. The irradiation section carriage 51 is provided with irradiation sections 52 (one example of ultraviolet irradiation device) for irradiating the UV ink ejected from the head 42 and adhered onto a sheet S with ultraviolet rays. The configuration of the irradiation section 52 will be described later in detail.

The cleaning unit 60 is used to clean the head 42 to prevent clogging of the nozzles of the head 42. For example, the cleaning unit 60 cleans the nozzles by forcibly ejecting UV ink from the head 42 (so-called flushing). Moreover, the cleaning unit 60 has an ink recovery unit 60*a* (to be described later) for recovering the flushed UV ink.

<<Printing>>

When receiving a print request and print data from the computer 110, the controller 10 analyzes the contents of various commands included in the print data to perform the following printing operation by using the units.

First, the sheet feed section 21 feeds a sheet S toward the holding drum 31. The sheet S fed to the holding drum 31 is held by being wound on the outer circumferential surface 33. The held sheet S is rotated together with the holding drum 31. The head 42 ejects UV ink, so that the UV ink is adhered onto the rotating sheet S. The UV ink adhered onto the sheet S is moved with the rotation of the holding drum 31 and then is irradiated with ultraviolet rays by the irradiation sections 52. In this manner, the UV ink on the sheet S is cured and an image is formed on the sheet S.

When the image is printed on the sheet S in a partial area in the axial direction of the holding drum 31 during the rotation of the holding drum 31, the head carriage 41 is moved along the guide shafts 46 and 47 (the irradiation section carriage 51 is also moved along the guide shafts 56 and 57). In an area adjacent to the above area in the axial direction, the above-described operations (ejection of UV ink by the head 42 and irradiation of ultraviolet rays by the irradiation sections 52) are performed.

The sheet S on which the entire image is printed in the axial direction of the holding drum 31 is peeled from the holding drum 31 and sent to the sheet discharge section 22. In this manner, printing is completed.

—Example of Configuration of Irradiation Section 52—

Figure 5:
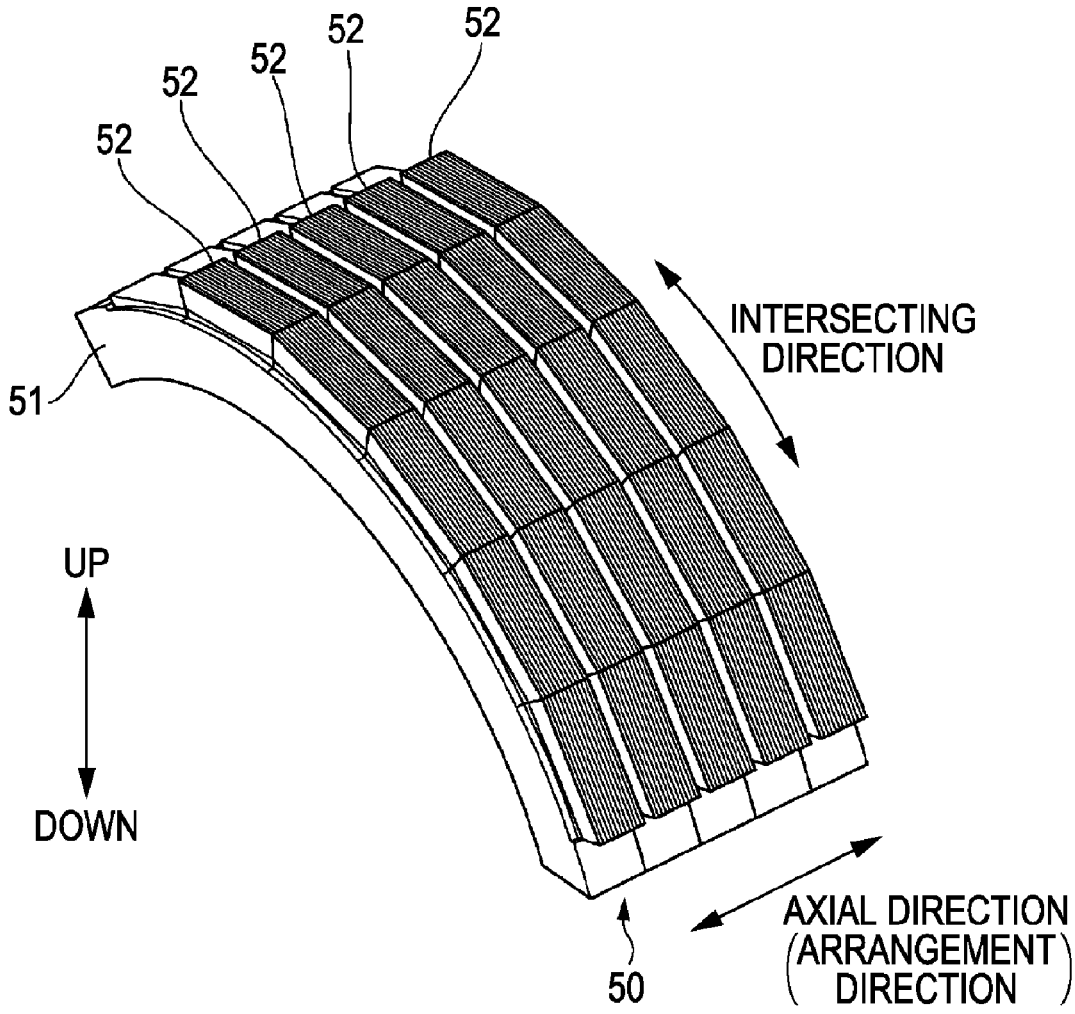
FIG. 5 is a perspective view of the ultraviolet irradiation unit.
Figure 6A:
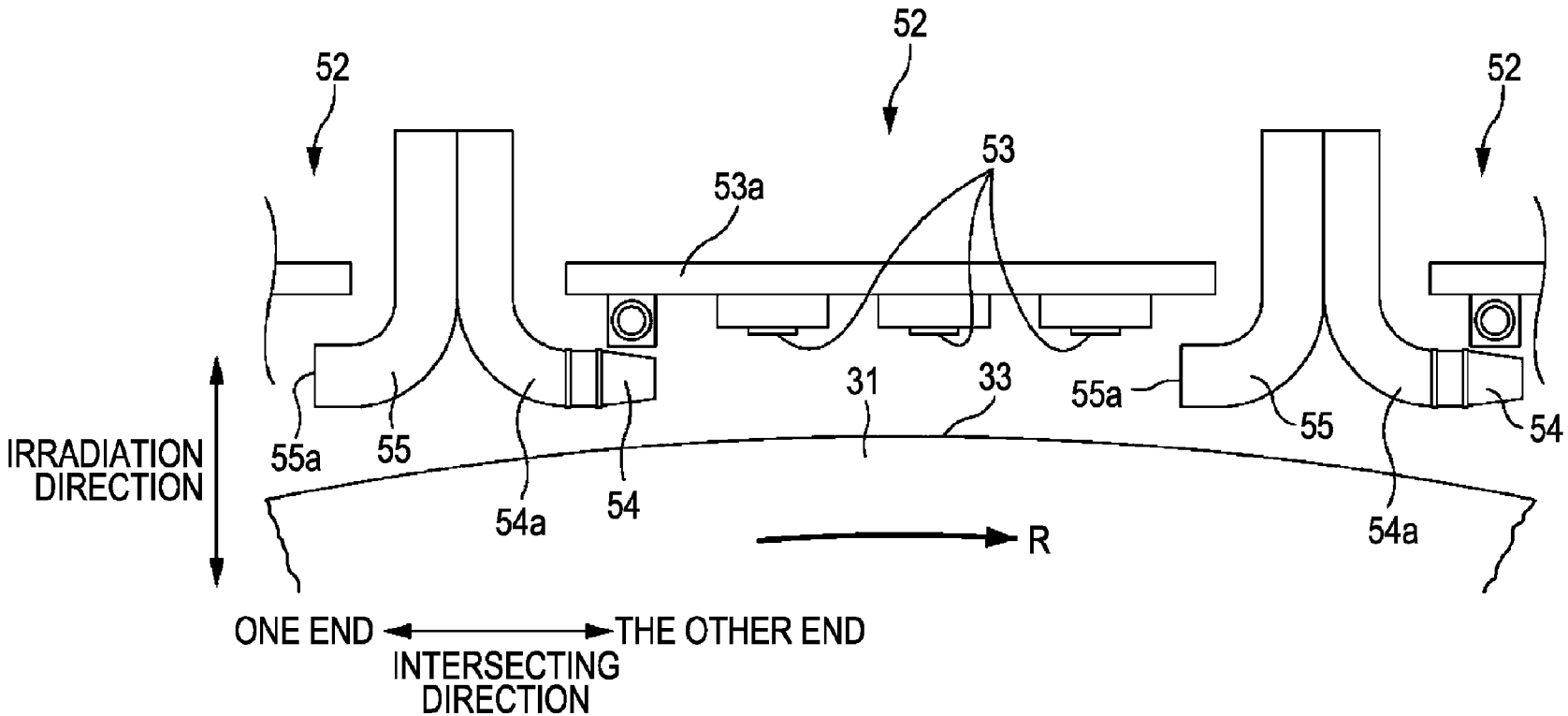
FIG. 6A is a front view of irradiation sections opposed to a holding drum.
Figure 6B:
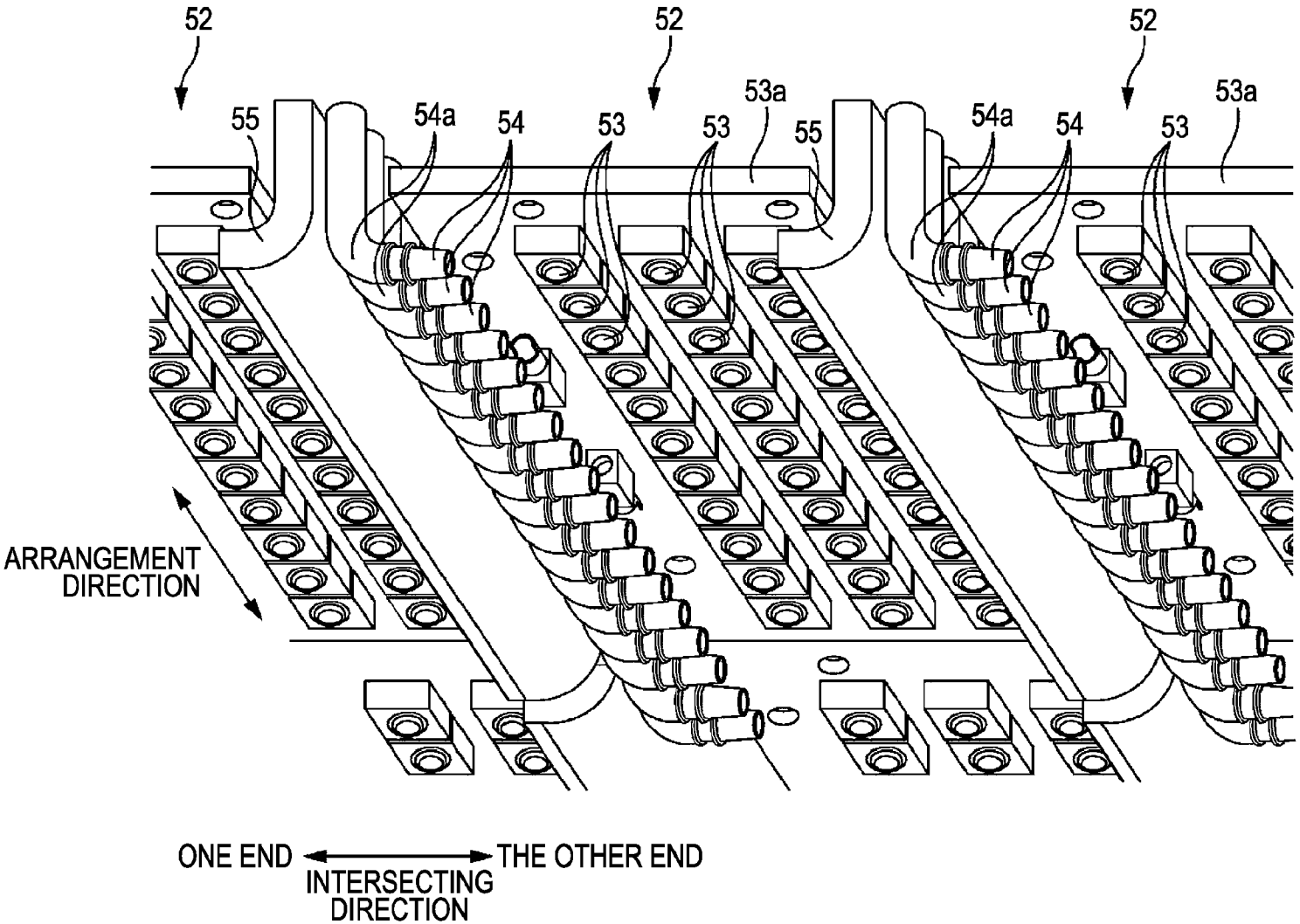
FIG. 6B is a perspective view of the irradiation sections, as viewed from the holding drum.
Figure 7:
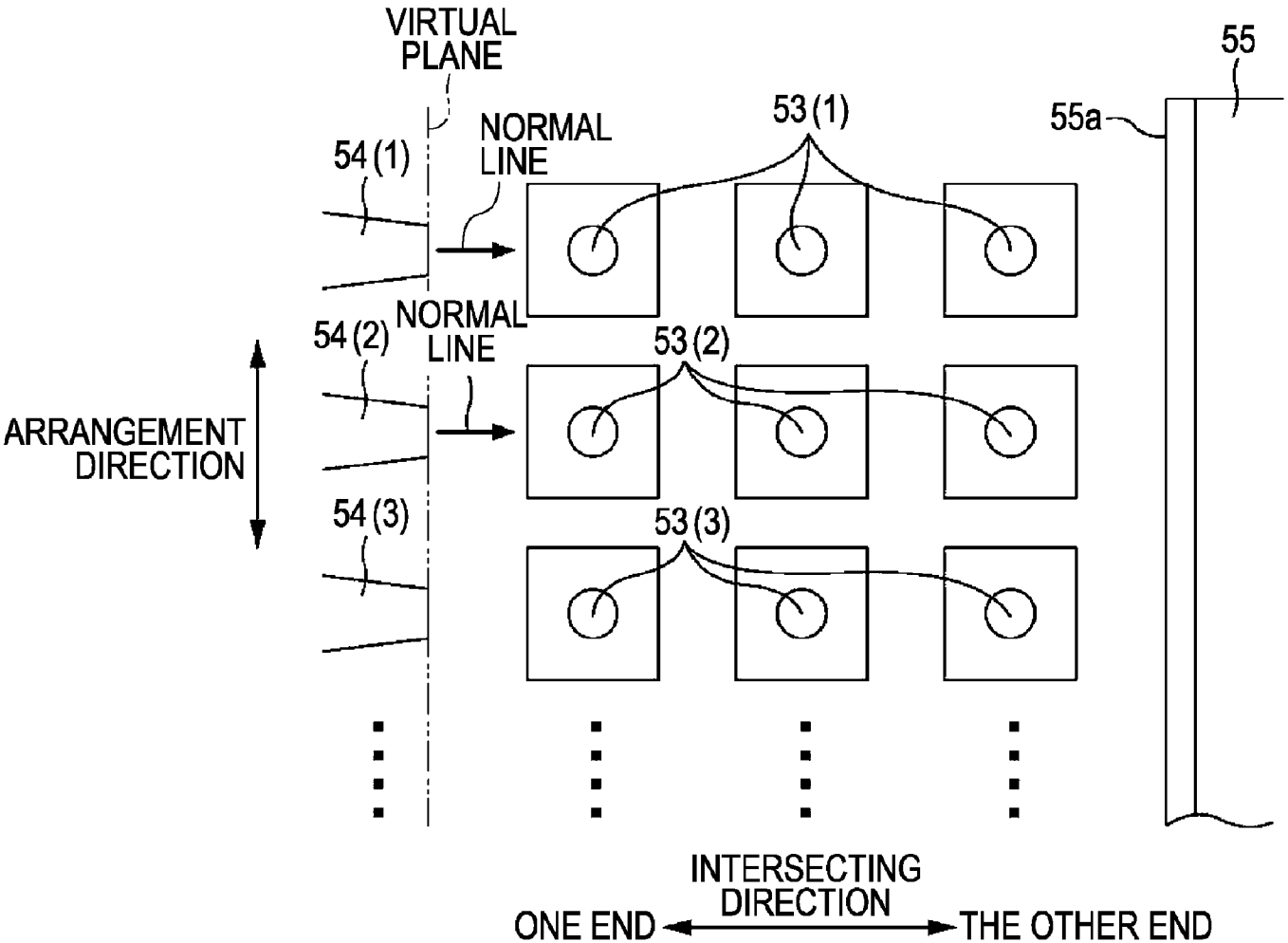
FIG. 7 is a schematic diagram illustrating a positional relationship between LEDs and air nozzles.
Figure 8:
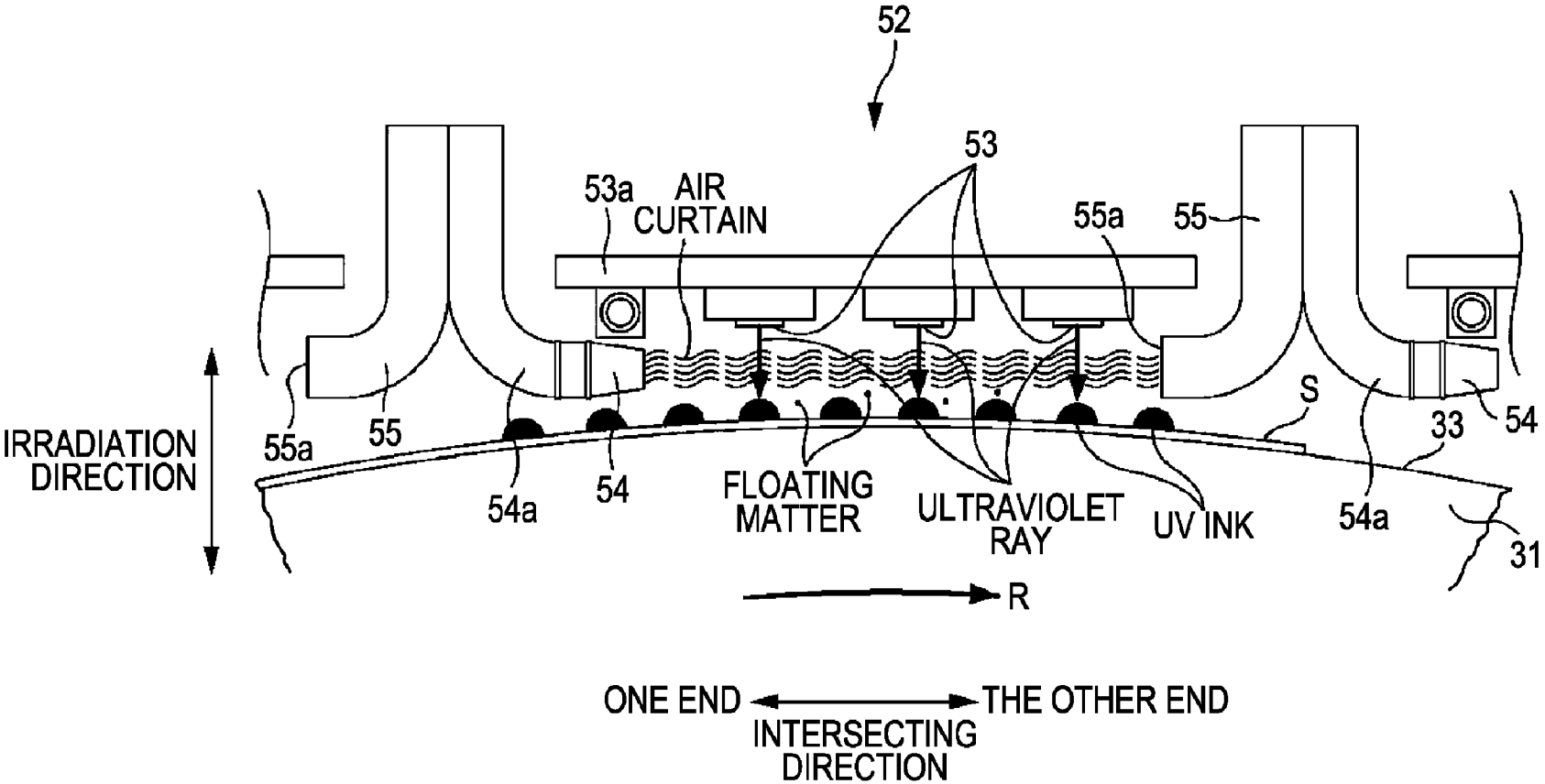
FIG. 8 is a diagram illustrating a state in which the UV ink adhered onto a sheet is irradiated with ultraviolet rays.

FIG. 5 is a perspective view of the ultraviolet irradiation unit 50. FIG. 6A is a front view of the irradiation sections 52 opposed to the holding drum 31. FIG. 6B is a perspective view of the irradiation sections 52, as viewed from the holding drum 31. FIG. 7 is a schematic diagram illustrating a positional relationship between LEDs 53 and air nozzles 54. FIG. 8 is a diagram illustrating a state in which the UV ink adhered onto a sheet S is irradiated with ultraviolet rays.

As illustrated in FIG. 5, the ultraviolet irradiation unit 50 of this embodiment has the plural irradiation sections 52. Since the irradiation sections 52 have the same configuration, the configuration of one irradiation section 52 will be described hereinafter.

The irradiation section 52 irradiates the UV ink adhered onto a sheet S with ultraviolet rays to cure the UV ink on the sheet S. As a result, an image is printed on the sheet S. The irradiation section 52 has LEDs 53 as an example of a light source, air nozzles 54 as an example of a jetting port and a duct 55.

<<Configuration of LED 53>>

The LED 53 is a light-emitting diode and irradiates ultraviolet rays. The LED 53 is opposed to the outer circumferential surface 33 of the holding drum 31 to irradiate the UV ink adhered onto a sheet S held on the outer circumferential surface 33 with ultraviolet rays. In addition, as illustrated in FIG. 6B, the plural LEDs 53 are arranged at predetermined intervals in an arrangement direction thereof (the LEDs 53 are arranged on a panel 53*a* in a regular manner). Accordingly, ultraviolet rays are irradiated over a wide range.

<<Configuration of Air Nozzle 54>>

As illustrated in FIG. 6A, the air nozzle 54 is provided at one end in an intersecting direction with respect to an irradiation direction of ultraviolet rays to jet air toward the other end in the intersecting direction. The air nozzle 54 is a tapered pipe provided at a front end of a pipeline 54*a* through which air goes. A mechanism (not shown) for generating a flow of air is provided in the pipeline 54*a*.

In this manner, by jetting air, an air film facing the LEDs 53 in the irradiation direction is formed as illustrated in FIG. 8. The air film (hereinafter, also referred to as the air curtain) has a function of preventing floating UV ink matter from being adhered to the LEDs 53. Accordingly, reduction of irradiation strength, which is caused by the adherence of the floating matter to the LEDs 53, can be suppressed. Since the ultraviolet rays irradiated from the LEDs 53 pass through the air curtain, it is difficult to cause a problem such as reduction of a degree of curing of UV ink.

Moreover, as illustrated in FIG. 6B, the plural air nozzles 54 are arranged at predetermined intervals in an arrangement direction thereof. Accordingly, an air film is formed over a wide range in the arrangement direction and thus the adherence of floating matter to the LEDs 53 is effectively suppressed.

A rotation direction (direction shown by the reference symbol R in FIG. 6A) of the holding drum 31 opposed to the LEDs 53 is a direction from one end to the other end in the intersecting direction. That is, the air nozzles 54 jet air in the rotation direction of the rotating holding drum 31. Accordingly, by receiving a force of the rotation of the holding drum 31, a force of the flow of air is increased. As a result, shielding is promoted and thus floating matter can be effectively prevented from being adhered to the LEDs 53.

Positions of the air nozzles 54 with respect to the LEDs 53 are as follows. That is, as illustrated in FIG. 7, normal lines, which pass through the centers of the air nozzles 54, respectively, of a virtual plane including front end faces of the air nozzles 54 pass over the LEDs 53. Specifically, the normal line of a first air nozzle 54(1) of three air nozzles 54 illustrated in FIG. 7 passes over three LEDs 53(1) aligned in the intersecting direction in FIG. 7. Like this, the normal line of an air nozzle 54(2) passes over three LEDs 53(2). Accordingly, in a portion opposed to the three LEDs 53(1) in the irradiation direction, a flow of air jetted from the air nozzle 54(1) is formed (in this flow, air jetted from other air nozzles can be included). That is, the plural air nozzles 54 jet air to form an air curtain for the corresponding LEDs 53. As a result, the air curtain is formed for the LEDs 53 in a regular manner.

In the above description, the air nozzles 54 jet air, but gas (however, this gas has a property to properly transmit ultraviolet rays) other than the air may be jetted.

<<Configuration of Duct 55>>

As illustrated in FIG. 6A, the duct 55 is provided at the other end in the intersecting direction to suck the air jetted from the air nozzle 54. The duct 55 has a suction port 55*a* for sucking air. The suction port 55*a* is provided in the arrangement direction and sucks the air jetted from each of the air nozzles 54. By sucking the air in this manner, an air flow direction is limited (that is, the air flows from one end toward the other end in the intersecting direction) and thus the flow of air between the air nozzle 54 and the duct 55 (that is, air curtain) is formed with high accuracy.

—Example of Operation of Ultraviolet Irradiation Unit 50 Upon Printing—

Figure 9:
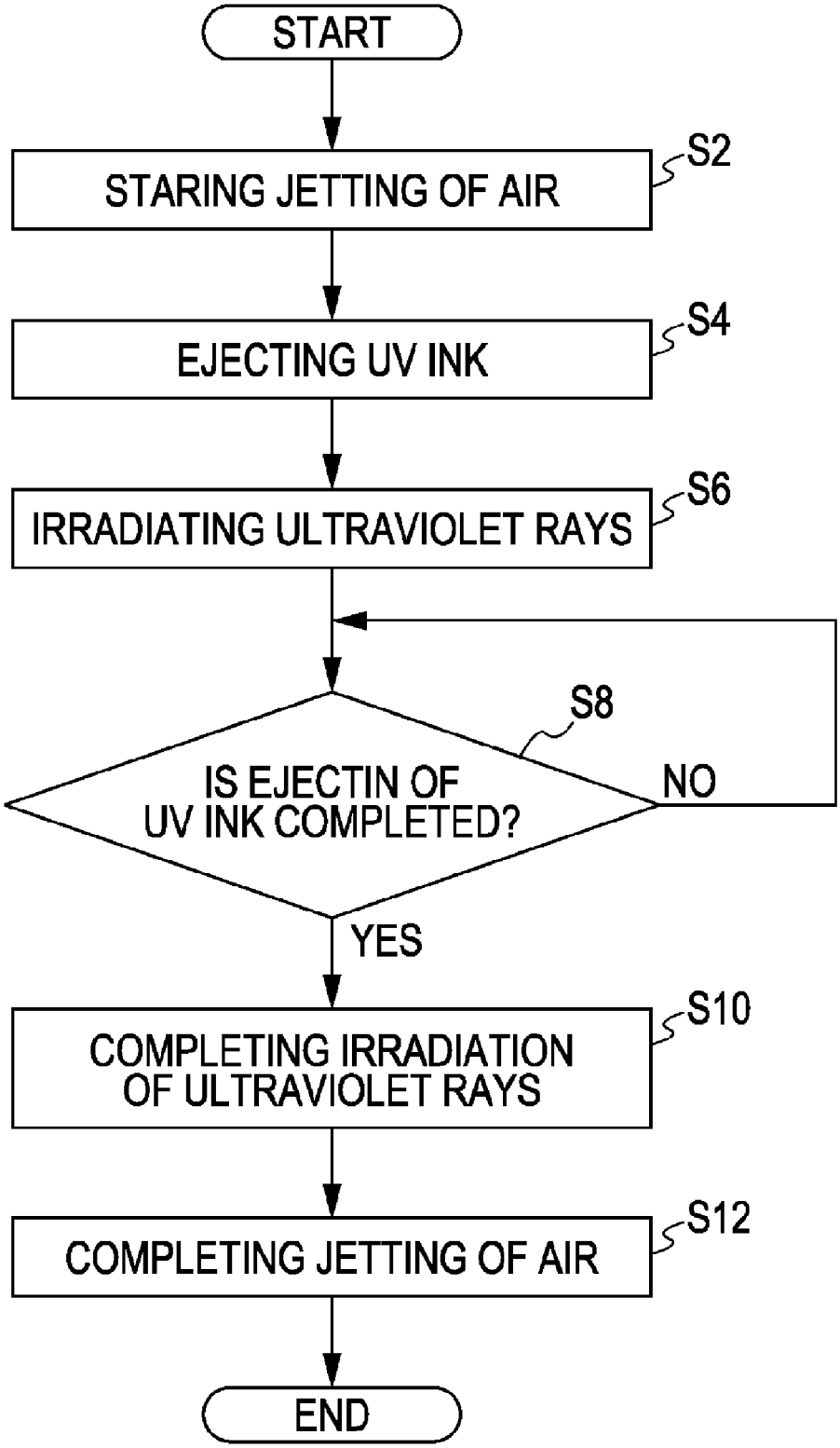
FIG. 9 is a flowchart illustrating an example of an operation of the ultraviolet irradiation unit upon printing.

FIG. 9 is a flowchart illustrating an example of an operation of the ultraviolet irradiation unit 50 upon printing. The flowchart starts from when the rotation of the holding drum 31 is started for printing.

Mainly, operations of the printer 1 when main operations are performed are realized by the controller 10. Particularly, in this embodiment, the program stored in the memory 13 is executed by being processed with the CPU 12.

First, the controller 10 starts the jetting of air from the air nozzle 54 (step S2). The air jetted from the air nozzle 54 positioned at one end in the intersecting direction flows toward the other end and is sucked by the duct 55. In this manner, the flow of air in the intersecting direction is generated, and as a result, an air curtain facing the LED 53 in the irradiation direction is formed, as illustrated in FIG. 8.

Next, the controller 10 causes the head 42 to eject UV ink (step S4). Accordingly, the UV ink is adhered onto a sheet S held by the rotating holding drum 31. The UV ink not adhered to the sheet S floats at the outer circumference of the holding drum 31. However, since the above-described air curtain is formed, the adherence of the floating UV ink to the LED 53 is suppressed.

Next, the controller 10 operates the LED 53 to irradiate the UV ink adhered onto the sheet S with ultraviolet rays (step S6). The irradiated ultraviolet rays pass through the air curtain and reach the UV ink. As described above, the adherence of floating matter such as floating UV ink to the LED 53 can be suppressed and thus an irradiation strength can be properly maintained.

Next, when the ejection of the UV ink from the head 42 is completed (step S8: Yes), the controller 10 completes the ultraviolet irradiation (step S10) and completes the jetting of the air (step S12). As described above, during the ejection of the UV ink (during printing), the air curtain is formed for the LED 53 by the air nozzle 54 and thus the adherence of floating matter to the LED 53 can be suppressed with high accuracy. As a result, the UV ink on the sheet S is properly cured and the reduction of an image quality of a printed image can be suppressed.

In this embodiment, the air nozzle 54 continuously jets air during the ejection of UV ink and thus the air curtain is continuously formed. However, the invention is not limited to this configuration, and for example, the air nozzle 54 may intermittently jet air.

Effectiveness of Printer 1 according to this Embodiment

As described above, the irradiation section 52 (ultraviolet irradiation device) of the printer 1 includes the LEDs 53 (light sources) for irradiating UV ink with ultraviolet rays and the air nozzles 54 (jetting port) for jetting gas for forming a film of the gas (herein, air) facing the LEDs 53 in the irradiation direction, as illustrated in FIG. 8.

In this case, the air film (air curtain) formed to be opposed to the LED 53 blocks the movement of floating matter to the LED 53 and thus the adherence of the floating matter to the LED 53 can be suppressed. Accordingly, the reduction of an irradiation strength (or irradiation efficiency) which is caused by the adherence of the floating matter to the LED 53, can be suppressed. As a result, ultraviolet rays can be properly irradiated by the LED 53.

Further, in this embodiment, as illustrated in FIG. 8, the air nozzle 54 is provided at one end in the intersecting direction with respect to the irradiation direction and jets air toward the other end in the intersecting direction. The irradiation section 52 is provided with the duct 55 provided at the other end in the intersecting direction and sucking the air jetted from the air nozzle 54.

In this case, by the duct 55, the flow of air jetted from the air nozzle 54 is limited. In this embodiment, the air flows in the intersecting direction and thus the air curtain opposed to the LED 53 in the irradiation direction is easily formed.

In the above embodiment, the air nozzle 54 is a pipe. In addition, as illustrated in FIG. 7, the normal line, which passes through the center of the air nozzle 54, of the virtual plane including the front end face of the air nozzle 54 pass over the LED 53.

In this case, the air jetted from the air nozzle 54 easily pass over the LED 53, the air curtain opposed to the LED 53 in the irradiation direction is effectively formed.

Furthermore, in this embodiment, as illustrated in FIG. 7, a predetermined number of the LEDs 53 are arranged in the arrangement direction. In addition, the same predetermined number of the air nozzles 54 are arranged in the arrangement direction. Moreover, the predetermined number of the air nozzles 54 jet air to form the film for the predetermined number of the corresponding LEDs 53.

In this case, even when the plural LEDs 53 are provided in the arrangement direction, the reduction of the irradiation strengths of the LEDs 53 can be suppressed since the air curtain is formed for the LEDs 53 by the air nozzles 54 corresponding to the LEDs 53.

In addition, in this embodiment, as illustrated in FIG. 3, the ultraviolet irradiation device is provided in the printer 1 including the head 42 for ejecting UV ink onto a sheet S and serves as the irradiation section 52 for irradiating the UV ink adhered onto the sheet S with ultraviolet rays.

In this case, the irradiation strength of the LED 53 is properly adjusted by forming the air curtain opposed to the LED 53. Accordingly, the UV ink adhered onto the sheet S is properly cured on the sheet S with the ultraviolet rays and thus the deterioration of an image quality of a printed image can be suppressed.

Moreover, in this embodiment, the printer 1 is provided with the holding drum 31 rotating and holding a sheet S on the outer circumferential surface 33 opposed to the LED 53. In addition, as illustrated in FIG. 8, the air nozzle 54 jets air in the rotation direction of the rotating holding drum 31.

In this case, a force of the air jetted from the air nozzle 54 increases with the rotation of the holding drum 31 and thus the adherence of floating matter to the LED 53 can be effectively suppressed.

Outline of Ultraviolet Irradiation Device According to Second Embodiment

The ultraviolet irradiation device in the above-described embodiment (first embodiment) is the irradiation section 52 of the ultraviolet irradiation unit 50. An ultraviolet irradiation device in a second embodiment to be described hereinafter is an irradiation section 66 provided in the ink recovery unit 60*a*. Hereinafter, the configuration of the ink recovery unit 60*a* will be described and then the configuration of the irradiation section 66 will be described.

<<Configuration of Ink Recovery Unit 60*a*>>

Figure 10:
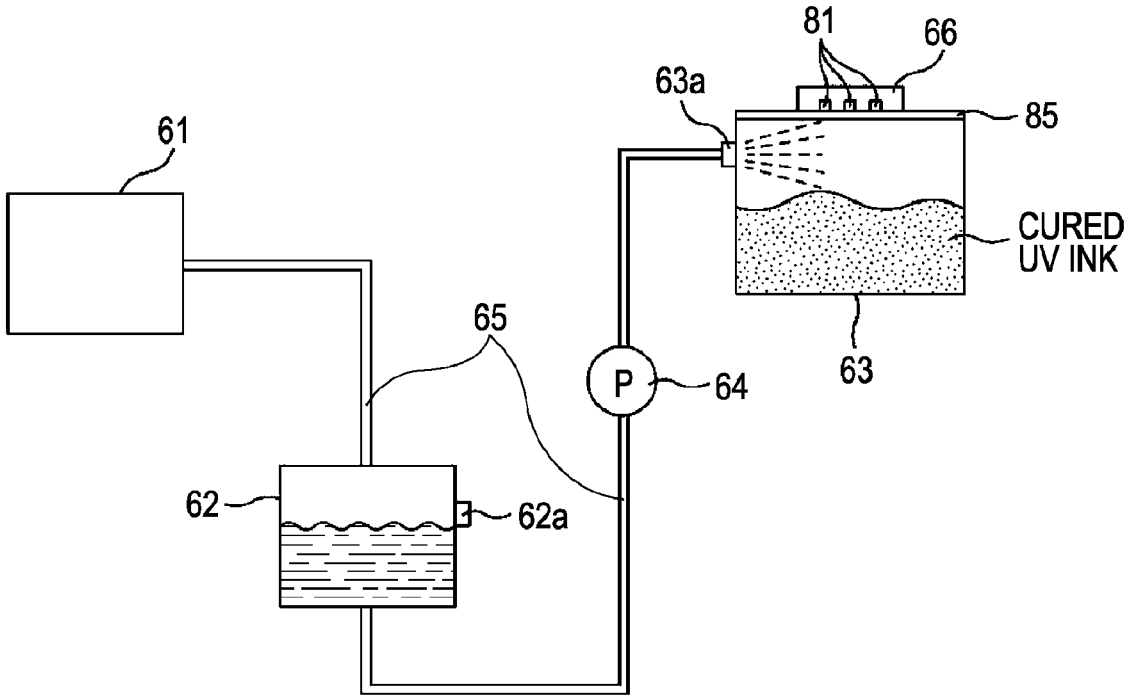
FIG. 10 is a schematic diagram illustrating the configuration of an ink recovery unit.

FIG. 10 is a schematic diagram illustrating the configuration of the ink recovery unit 60*a*.

The ink recovery unit 60*a* is a part of the cleaning unit 60 as described above and is used to recover the UV ink ejected from the nozzle by flushing. The ink recovery unit 60*a* has an ink reception section 61, a storage section 62, an ink curing section 63 and a pump 64.

The ink reception section 61 is used to receive the UV ink ejected from the head 42. The ink reception section 61 has a sponge for absorbing the received UV ink. In addition, the ink reception section 61 is provided with a capping device for sealing the nozzles of the head 42 to effectively perform the flushing.

The storage section 62 is used to store the UV ink flowing in an ink passage 65 from the ink reception section 61. The storage section 62 is provided with a level sensor 62*a* for detecting a level of the UV ink in the storage section 62.

The ink curing section 63 irradiates sprayed UV ink with ultraviolet rays to cure the UV ink. The ink curing section 63 has a spray section 63*a* for spraying UV ink. Further, the ink curing section 63 is provided with the irradiation section 66 (to be described later in detail) for irradiating sprayed UV ink with ultraviolet rays on the spray section 63*a* (specifically, in an upper wall of the ink curing section 63). Since the ink curing section 63 having such a configuration cures the UV ink, a disposal process for the UV ink is easily performed.

The pump 64 is used to suck the UV ink stored in the storage section 62 and send the UV ink to the ink curing section 63. The pump 64 is provided between the storage section 62 and the ink curing section 63 in the ink passage 65.

<<Configuration of Irradiation Section 66>>

Figure 11A:
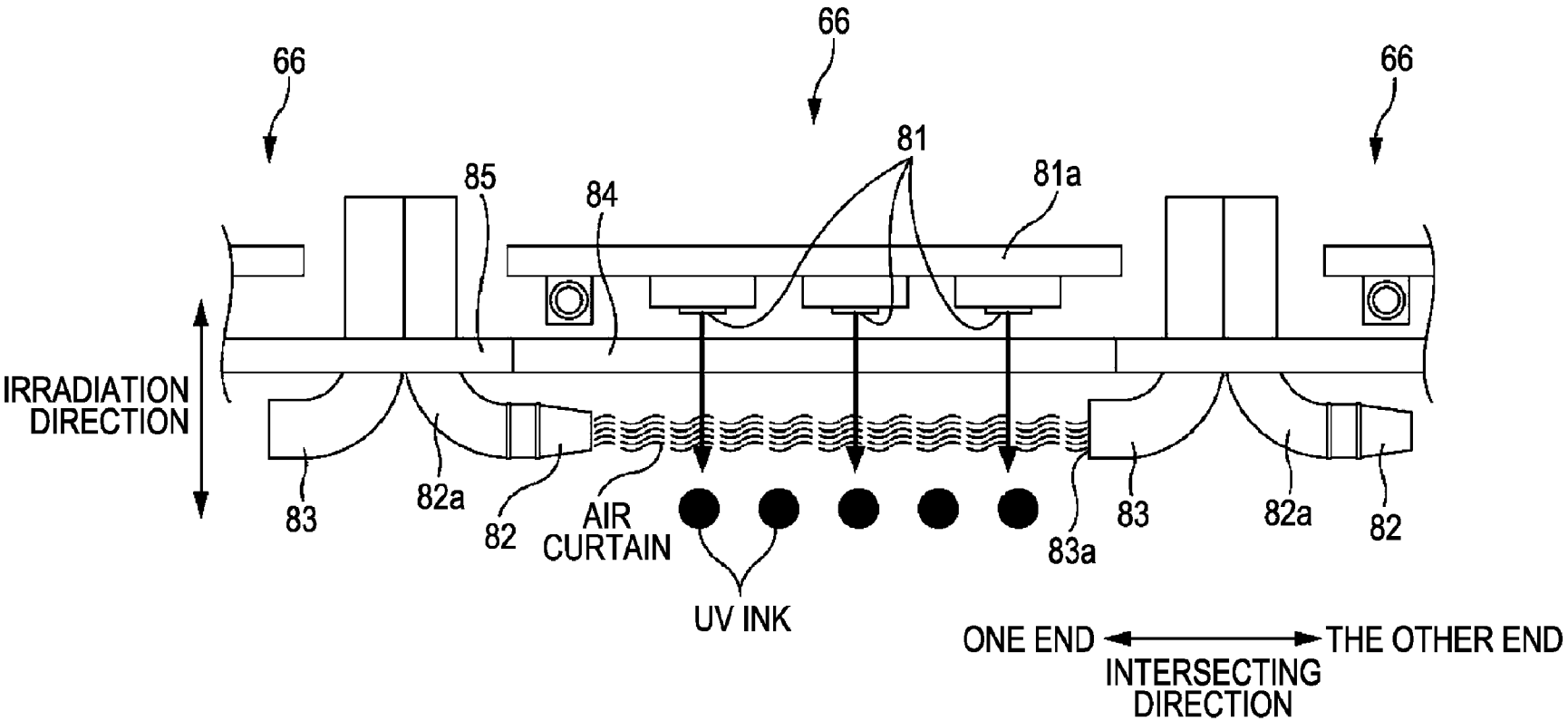
FIG. 11A is a front view of irradiation sections.
Figure 11B:
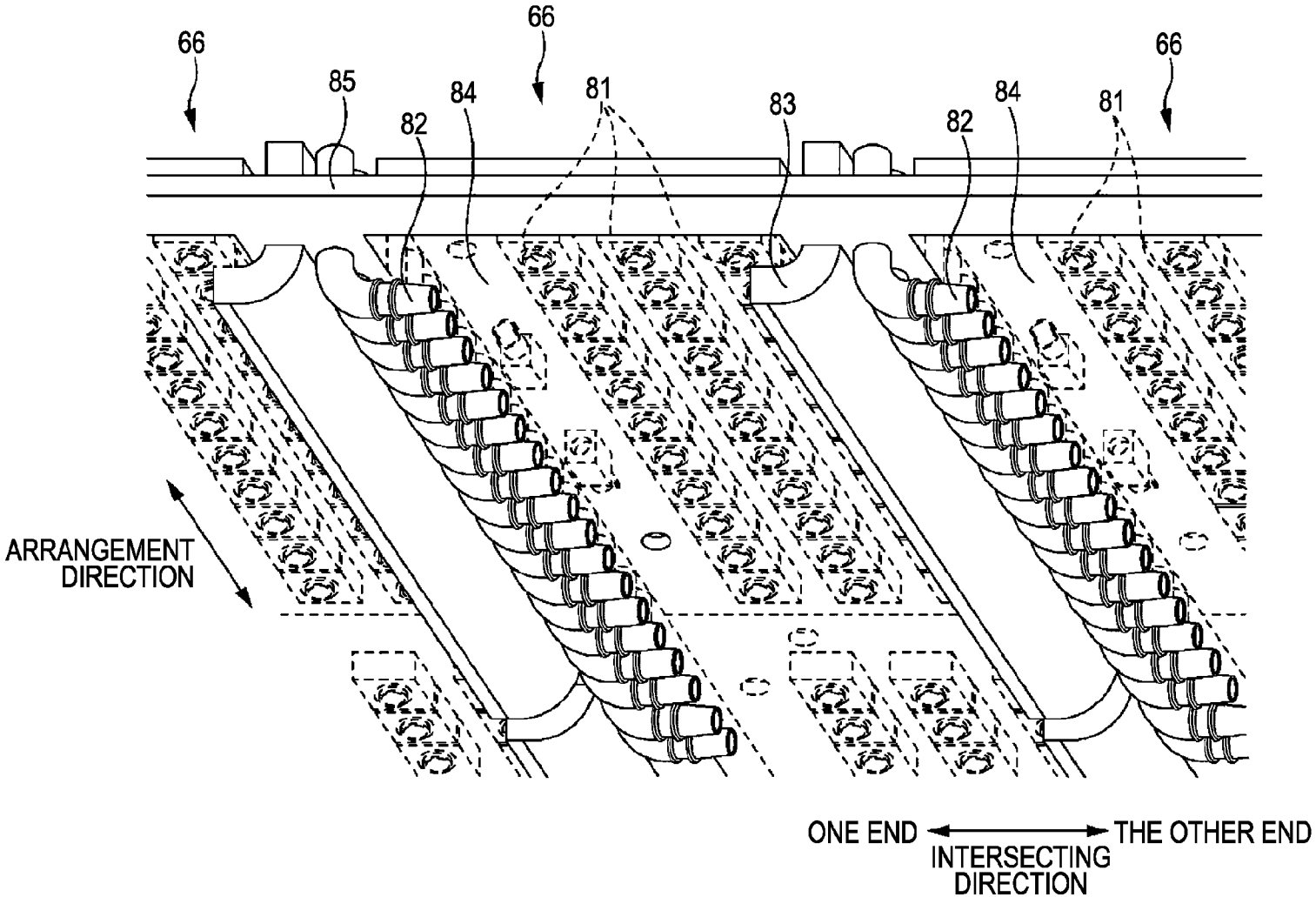
FIG. 11B is a perspective view of the irradiation sections.

FIG. 11A is a front view of the irradiation sections 66. FIG. 11B is a perspective view of the irradiation sections 66. LEDs 81 illustrated in FIG. 11B are disposed at a position opposed to a transparent plate 84. Accordingly, the LEDs 81 are shown by dotted lines.

Like the above-described ultraviolet irradiation unit 50, the ink recovery unit 60*a* is provided with the plural irradiation sections 66. Since the irradiation sections 66 have the same configuration, the configuration of one irradiation section 66 will be described.

The irradiation section 66 is used to irradiate with ultraviolet rays the UV ink which is not adhered to a sheet S and then is recovered. Like the irradiation section 52 of the ultraviolet irradiation unit 50, the irradiation section 66 has LEDs 81, air nozzles 82 and a duct 83. In addition, the irradiation section 66 has the transparent plate 84, unlike the irradiation section 52.

The LED 81 irradiates sprayed UV ink with ultraviolet rays. As illustrated in FIG. 11B, the plural LEDs 81 are arranged at predetermined intervals in an arrangement direction thereof (the LEDs 81 are arranged on a panel 81*a* in a regular manner).

The air nozzle 82 is provided at one end in an intersecting direction with respect to an irradiation direction to jet air toward the other end in the intersecting direction.

The duct 83 is provided at the other end in the intersecting direction to suck the air jetted from the air nozzle 82 by a suction port 83*a*. The suction port 83*a* is provided in the arrangement direction and sucks the air jetted from each of the air nozzles 82.

The configurations of the LED 81, the air nozzle 82 and the duct 83 are almost the same as the configurations in the irradiation section 52. As a result, a flow of air (air curtain) is generated from the air nozzle 82 to the duct 83 and thus the adherence of sprayed UV ink to the LED 81 can be suppressed.

The transparent plate 84 is attached to a panel 85 partially forming the upper wall of the ink curing section 63. The transparent plate 84 is provided to be closer to the LED 81 than the air nozzle 82 in the irradiation direction and face the LED 81. In addition, the transparent plate 84 transmits the ultraviolet rays irradiated from the LED 81. The transparent plate 84 has a function of a shielding plate for preventing UV ink from being adhered to the LED 81. By the air curtain, the adherence of the UV ink to the transparent plate 84 can be suppressed.

<<Example of Operation of Irradiation Section 66 Upon Recovery of Ink>>

Figure 12:
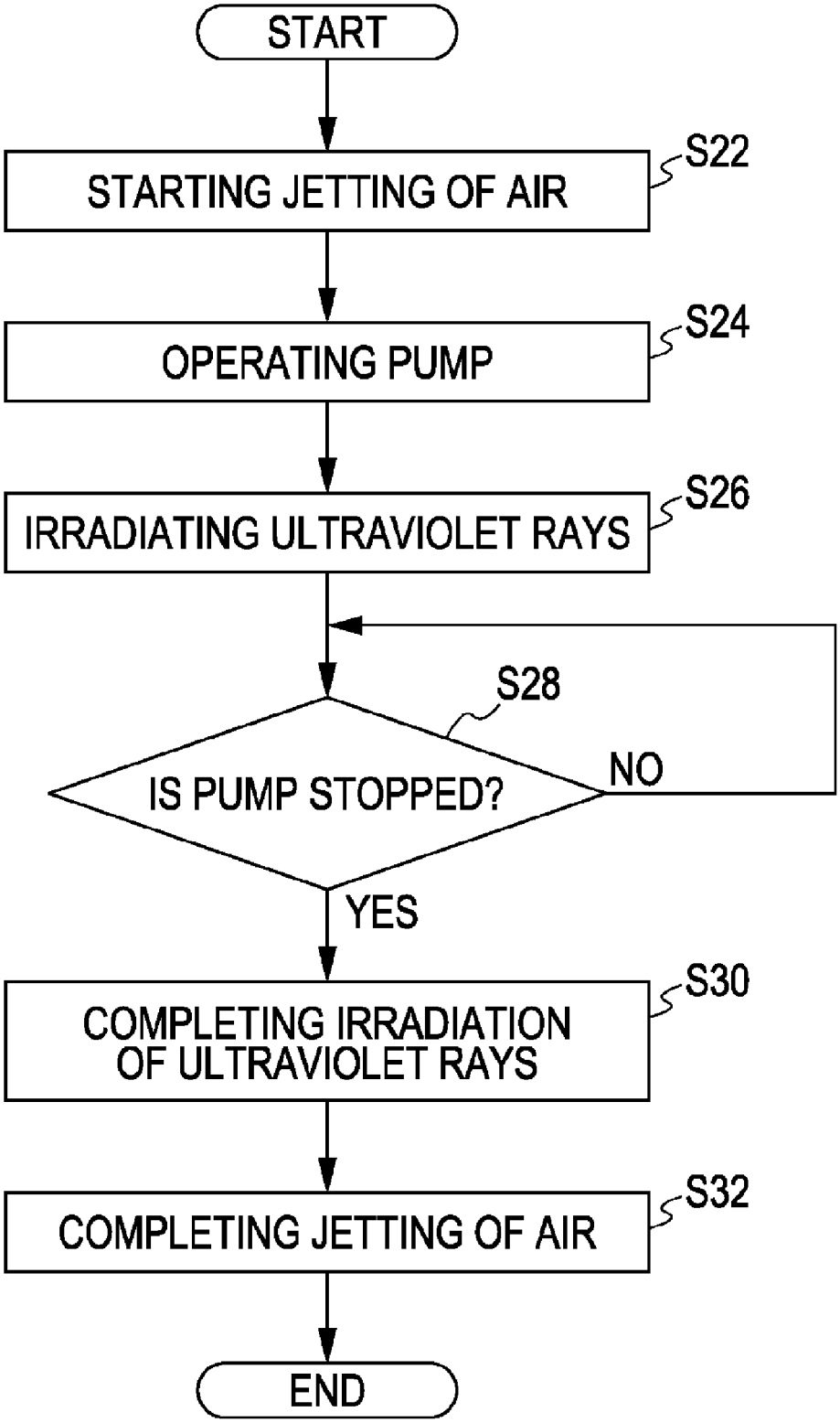
FIG. 12 is a flowchart illustrating an example of an operation of the irradiation section upon the recovery of ink.

FIG. 12 is a flowchart illustrating an example of an operation of the irradiation section 66 upon the recovery of ink. The flowchart starts from when the level sensor 62*a* detects that a level of the UV ink stored in the storage section 62 rises (an ink amount is increased).

First, the controller 10 starts the jetting of air from the air nozzle 82 (step S22). Accordingly, an air film (air curtain) from the air nozzle 82 toward the duct 83 is formed for the LED 81.

Next, the controller 10 operates the pump 64 (step S24). Accordingly, the UV ink in the storage section 62 is directed to the curing section 63 through the ink passage 65. The UV ink flowing through the ink passage 65 is sprayed by the spray section 63*a*.

Next, the controller 10 causes the LED 81 to irradiate ultraviolet rays (step S26). That is, the ultraviolet rays irradiated from the LED 81 are transmitted through the transparent plate 84 and reach the floating UV ink. Accordingly, the sprayed UV ink is cured and collected in a lower portion of the curing section 63.

Further, when the operation of the pump 64 is stopped (step S28: Yes), the controller 10 completes the ultraviolet irradiation (step S30). In addition, the controller 10 completes the jetting of the air from the air nozzle 82 (step S32). As a result, the air curtain opposed to the LED 81 is formed while the UV ink is sprayed. Thus, the adherence of the UV ink to the LED 81 can be suppressed.

As described above, in the second embodiment, air is jetted from the air nozzle 82 to form the air film facing the LED 81 in the irradiation direction. Accordingly, the same advantage as in the first embodiment, that is, an advantage of suppressing the adherence of the UV ink to the LED 81 is obtained. As a result, the ultraviolet irradiation of the LED 81 can be properly performed.

In the second embodiment, the irradiation section 66 is provided with the transparent plate 84, but the transparent plate 84 may be not provided. Likewise, in the first embodiment, the transparent plate is not provided, but the transparent plate may be provided.

Other Embodiments

The printer and the like as an embodiment have been described. However, the above embodiments are illustrated for easy understanding of the invention and not limiting the invention. It is obvious that various changes and modifications may be made and equivalents thereof may be included in the invention without departing from the gist of the invention. Particularly, the invention includes embodiments described below.

In the above-described embodiments, the printer has been described, but the invention is not limited to this. The same technique as in the embodiments may be applied to various ink ejection devices based on the ink jet technique, such as a color filter manufacturing device, a dyeing device, a fine processing device, a semiconductor manufacturing device, a surface processing device, a three-dimensional shape forming machine, a liquid vaporizing device, an organic EL manufacturing device (particularly, macromolecular EL manufacturing device), a display manufacturing device, a film formation device and a DNA chip manufacturing device.

In the above-described embodiments, the light-emitting diode is used as the light source, but the light source is not limited to this. The light source may employ another configuration as long as it is a light source for irradiating ultraviolet rays. Further, the ink ejection method is not limited to a method using a piezoelectric element and can be applied to, for example, a thermal printer.

What is claimed is:

1. An ultraviolet irradiation device comprising:

a light source which irradiates ultraviolet curable ink with ultraviolet rays; and a jetting port which jets gas to form a gas film across the light source in an irradiation direction; and a transparent plate which is provided to be closer to the light source than the jetting port in the irradiation direction and face the light source to transmit the ultraviolet rays irradiated from the light source.

2. An ultraviolet irradiation device comprising:

a light source which irradiates ultraviolet curable ink with ultraviolet rays; and a jetting port which jets gas to form a gas film across the light source in an irradiation direction, wherein the jetting port is a pipe, and wherein a normal line, which passes through the center of the jetting port, of a virtual place including a top end face of the jetting port passes over the light source.

3. An ultraviolet irradiation device comprising:

a light source which irradiates ultraviolet curable ink with ultraviolet rays; and a jetting port which jets gas to form a gas film across the light source in an irradiation direction, wherein a predetermined number of the light sources are arranged in an arrangement direction, wherein a predetermined number of the jetting ports are arranged in the arrangement direction, and wherein the predetermined number of the jetting ports jet the gas to form the film for the predetermined number of the corresponding light sources.

4. An ultraviolet irradiation device comprising:

a light source which irradiates ultraviolet curable ink with ultraviolet rays; and a jetting port which jets gas to form a gas film across the light source in an irradiation direction, wherein the ultraviolet irradiation device is provided in an ink election device having a head which ejects the ultraviolet curable ink onto a medium, and serves as an irradiation section which irradiates with the ultraviolet rays the ultraviolet curable ink adhered onto the medium, wherein the ink ejection device includes a rotation body rotating and holding the medium on an outer circumferential surface opposed to the light source, and wherein the jetting port jets the gas in a rotation direction of the rotating rotation body.

5. An ultraviolet irradiation device comprising:

a light source which irradiates ultraviolet curable ink with ultraviolet rays; and a jetting port which jets gas to form a gas film across the light source in an irradiation direction, wherein the ultraviolet irradiation device is provided in an ink ejection device having a head which ejects the ultraviolet curable ink onto a medium, and serves as an irradiation section which irradiates with the ultraviolet rays the ultraviolet curable ink which is not adhered to the medium and then is recovered.

6. An ultraviolet irradiation device comprising:

a light source which irradiates ultraviolet curable ink with ultraviolet rays; and a jetting port which jets gas to form a gas film facing the light source in an irradiation direction, wherein the jetting port is provided at one end in an intersecting direction with respect to the irradiation direction to jet the gas toward the other end in the intersecting direction, and wherein the ultraviolet irradiation device further comprises a duct which is provided at the other end in the intersecting direction to suck the gas jetted from the jetting port.

7. The ultraviolet irradiation device according to claim 6, further comprising:

a transparent plate which is provided to be closer to the light source than the jetting port in the irradiation direction and face the light source to transmit the ultraviolet rays irradiated from the light source.

8. The ultraviolet irradiation device according to claim 6, wherein the jetting port is a pipe, and wherein a normal line, which passes through the center of the jetting port, of a virtual place including a top end face of the jetting port passes over the light source.

9. The ultraviolet irradiation device according to claim 6, wherein a predetermined number of the light sources are arranged in an arrangement direction, wherein a predetermined number of the jetting ports are arranged in the arrangement direction, and wherein the predetermined number of the jetting ports jet the gas to form the film for the predetermined number of the corresponding light sources.

10. The ultraviolet irradiation device according to claim 6, wherein the ultraviolet irradiation device is provided in an ink ejection device having a head which ejects the ultraviolet curable ink onto a medium, and serves as an irradiation section which irradiates with the ultraviolet rays the ultraviolet curable ink adhered onto the medium.

11. The ultraviolet irradiation device according to claim 10, wherein the ink ejection device includes a rotation body rotating and holding the medium on an outer circumferential surface opposed to the light source, and wherein the jetting port jets the gas in a rotation direction of the rotating rotation body.

12. The ultraviolet irradiation device according to claim 6, wherein the ultraviolet irradiation device is provided in an ink ejection device having a head which ejects the ultraviolet curable ink onto a medium, and serves as an irradiation section which irradiates with the ultraviolet rays the ultraviolet curable ink which is not adhered to the medium and then is recovered.

* * * * *